US007296639B2

(12) United States Patent
Millar et al.

(10) Patent No.: US 7,296,639 B2
(45) Date of Patent: Nov. 20, 2007

(54) WELLSTRING ASSEMBLY

(75) Inventors: Ian Alexander Millar, Aberdeen (GB); Douwe Johannes Runia, Rijswijk (NL); Paul Neilson Wood, Scotland (GB)

(73) Assignee: Shell Oil Company, Houston, TX (US)

( * ) Notice: Subject to any disclaimer, the term of this patent is extended or adjusted under 35 U.S.C. 154(b) by 336 days.

(21) Appl. No.: 10/541,638

(22) PCT Filed: Jan. 14, 2004

(86) PCT No.: PCT/EP2004/050017

§ 371 (c)(1),
(2), (4) Date: Jul. 7, 2005

(87) PCT Pub. No.: WO2004/063522

PCT Pub. Date: Jul. 29, 2004

(65) Prior Publication Data

US 2006/0118298 A1 Jun. 8, 2006

(30) Foreign Application Priority Data

Jan. 15, 2003 (EP) ..... 03250242
Jan. 15, 2003 (EP) ..... 03250243
Apr. 24, 2003 (EP) ..... 03076196

(51) Int. Cl.
*E21B 47/00* (2006.01)
*E21B 10/04* (2006.01)

(52) U.S. Cl. ..... 175/57; 175/61; 175/385; 166/242.7

(58) Field of Classification Search ..... None
See application file for complete search history.

(56) References Cited

U.S. PATENT DOCUMENTS 2,179,010 A 11/1939 Creighton et al ..... 255/72
2,284,580 A 5/1942 Kammerer ..... 255/61
2,719,361 A 10/1955 Montgomery et al. ..... 33/178
2,719,363 A 10/1955 Montgomery et al. ..... 33/178
2,726,848 A 12/1955 Montgomery et al. ..... 255/28
2,936,832 A 5/1960 Brown et al. ..... 166/115
2,997,119 A 8/1961 Goodwin ..... 175/101
3,052,838 A 9/1962 Bennett et al. ..... 324/10
3,112,442 A 11/1963 Bennett ..... 324/1

(Continued)

FOREIGN PATENT DOCUMENTS

EP 0310215 4/1989

(Continued)

OTHER PUBLICATIONS

International Search Report dated May 4, 2004.

(Continued)

*Primary Examiner*—Frank Tsay

(57) ABSTRACT

A wellstring assembly comprising a tubular first wellstring part with a passageway; a second wellstring part co-operating with the first wellstring part; and a releasable wellstring-interconnecting means for selectively interconnecting the first and second wellstring parts; an auxiliary tool for manipulating the second wellstring part, which auxiliary tool can pass along the passageway in the first wellstring part to the second wellstring part, comprising a tool-connecting means for selectively connecting the auxiliary tool to the second wellstring part, and an operating means for operating the wellstring-interconnecting means.

11 Claims, 12 Drawing Sheets

U.S. PATENT DOCUMENTS

| | | | | |
|---|---|---|---|---|
| 3,169,591 | A | 2/1965 | Worthington et al. | 175/257 |
| 3,429,387 | A | 2/1969 | Brown | 175/237 |
| 3,437,159 | A | 4/1969 | Link et al. | 175/260 |
| 3,554,304 | A | 1/1971 | Link et al. | 175/259 |
| 3,661,218 | A | 5/1972 | Brown | 175/107 |
| 3,700,049 | A | 10/1972 | Tiraspolsky et al. | 175/50 |
| 3,747,674 | A | 7/1973 | Murray | 166/98 |
| 3,842,914 | A | 10/1974 | Mott | 166/315 |
| 3,872,721 | A | 3/1975 | Ilfrey | 73/151 |
| 3,894,590 | A * | 7/1975 | Takano et al. | 175/107 |
| 4,204,426 | A | 5/1980 | Patton et al. | 73/151 |
| RE32,336 | E | 1/1987 | Escaron et al. | 166/250 |
| 4,807,704 | A | 2/1989 | Hsu et al. | 166/313 |
| 4,932,005 | A | 6/1990 | Birdwell | 367/83 |
| 5,244,050 | A | 9/1993 | Estes | 174/393 |
| 5,472,057 | A | 12/1995 | Winfree | 175/57 |
| 5,507,357 | A | 4/1996 | Hult et al. | 175/385 |
| 5,695,009 | A | 12/1997 | Hipp | 166/196 |
| 5,782,261 | A | 7/1998 | Becker et al. | 137/155 |
| 6,003,607 | A | 12/1999 | Hagen et al. | 166/381 |
| 6,345,669 | B1 | 2/2002 | Buyers et al. | 166/381 |
| 7,140,454 | B2 * | 11/2006 | Runia | 175/57 |
| 7,207,398 | B2 * | 4/2007 | Runia et al. | 175/61 |
| 2002/0162656 | A1 | 11/2002 | Dewey | 166/117.5 |
| 2004/0026126 | A1 | 2/2004 | Angman | 175/57 |
| 2004/0238218 | A1 | 12/2004 | Runia et al. | 175/57 |
| 2004/0238224 | A1 | 12/2004 | Runia | 175/339 |

FOREIGN PATENT DOCUMENTS

| | | | |
|---|---|---|---|
| GB | 2146126 | A | 11/1985 |
| WO | 00/17488 | | 3/2000 |
| WO | 03/004820 | | 1/2003 |
| WO | 03/004825 | | 1/2003 |
| WO | 03/010410 | | 2/2003 |
| WO | WO2004094783 | A1 | 4/2004 |

OTHER PUBLICATIONS

European Patent Search Report dated Jun. 4, 2003.

* cited by examiner

WELLSTRING ASSEMBLY

The present application claims priority on European Patent Application 03250242.9 filed 15 Jan. 2003; European Patent Application 03250243.7 filed 15 Jan. 2003 and European Patent Application 03076196.9 filed 24 Apr. 2003.

FIELD OF THE INVENTION

The present invention relates to a wellstring assembly for use in a well extending downwardly from the earth's surface. In a particular aspect the invention relates to a well-drilling bit assembly suitable for performing a through-bit operation.

BACKGROUND OF THE INVENTION

The expression wellstring is used to refer to any string or well tubular used for operations in a borehole, such as drilling, logging, fluid transportation. The well string does not necessarily need to be tubular over its entire length. The well string can in particular be a drill string, and can include a well-drilling bit.

International patent application with publication No. WO 00/17488 discloses a system for drilling and logging of a wellbore formed in an earth formation, wherein a logging tool can be lowered in the wellbore from inside a drill string through a well drilling bit at the lower end of the drill string.

The known system comprises a well-drilling bit including a bit body provided with a passageway for the logging tool, and a closure element for the passageway in the form of an insert section at the bit face. The bit body is attachable to a tubular drill string at a drill-string side of the bit body, and the passageway extends from an opening at the drill-string side to the well exterior of the bit body. The closure element comprises a bit-connecting means in the form of a primary latching device for selectively connecting the closure element to the bit body, so as to selectively close the passageway.

The known system further comprises an auxiliary tool for manipulating the closure element, which auxiliary tool forms the downstream part of a logging tool string.

In the specification and in the claims the terms upstream, upper and downstream, lower are used in relation to the lowering of a tool into a borehole, so that upstream, upper is closer to the surface than downstream, lower.

The logging tool string of the known system is arranged so that it can pass from the attached drill string through the opening of the bit body at the drill-string side, along the passageway so that it can reach the closure element, when the closure element is connected to the bit body. The auxiliary tool comprises a tool-connecting means in the form of a secondary latching device for selectively connecting the auxiliary tool to the closure element. The secondary latching device is further so arranged that simultaneously with the latching of the auxiliary tool to the closure element, the primary latching mechanism is operated so that the closure element is unlatched from the bit body while remaining attached to the auxiliary tool.

The well drilling bit of the known system can be used for drilling operation, when the closure element is connected to the bit body. When it is desired to log the formation, drilling operation is stopped, and the logging tool string with the auxiliary tool at its lower end is lowered through the drill string into the passageway. The tool-connecting means (secondary latching mechanism) is connected to the closure element, and, simultaneously, the bit-connecting means (primary latching mechanism) is operated so as to release the closure element from the bit body. Then, the logging tool can be lowered into the wellbore ahead of the well drilling bit from where logging can be performed. After logging has been completed, the logging tool string can be pulled back into the drill string, so that the closure element is reconnected to the bit body and the auxiliary tool is simultaneously disconnected from the closure element.

The known system has the disadvantage of limited robustness. Fail-safe operation of downhole equipment is generally very important in well drilling operations. With the known system there is for example a risk that the closure element is not sufficiently connected to the bit body in a situation wherein the auxiliary tool is not fully connected to the closure element. This can happen during removal of the closure element, and also when it is attempted to re-insert the closure element after logging was completed. Consequently, the closure element could be lost in the wellbore. The latching mechanism disclosed in International Patent Application publication No. WO 03/004825, which was unpublished at the priority date of the present application, has the same disadvantage. U.S. Pat. No. 3,554,304 discloses a well-drilling bit with cutter elements that are lowered on a conventional wireline with overshot through the drill pipe and locked to the lower end of the drill pipe by a latching mechanism. The wireline can be pulled back to surface and lowered again to reconnect to the cutter element. For removing the cutter elements to surface, the latching mechanism is released by simply pulling the wireline.

SUMMARY OF THE INVENTION

It is an object of the present invention to provide a wellstring assembly that allows access to the well outside of the wellstring via a latching mechanism, and which allows robust and fail-safe operation. It is a particular object to provide a well-drilling bit assembly suitable for through-bit operation, which allows robust and fail-safe operation of the connections between the closure element and the bit body and between the closure element and the auxiliary tool.

To this end in accordance with the present invention there is provided a wellstring assembly comprising a wellstring element, which includes a tubular first wellstring part having upper and lower ends between which ends a passageway is arranged;

a second wellstring part co-operating with the lower end of the first wellstring part; and a releasable wellstring-interconnecting means for selectively interconnecting the first and second wellstring parts;

the wellstring assembly further comprising an auxiliary tool for manipulating the second wellstring part, which auxiliary tool is arranged so that it can pass along the passageway in the first wellstring part to the second wellstring part, when the first and second wellstring parts are interconnected, wherein the auxiliary tool comprises a tool-connecting means for selectively connecting the auxiliary tool to the second wellstring part, and an operating means for operating the wellstring-interconnecting means, wherein the auxiliary tool comprises a first member which includes the tool-connecting means and a second member which includes the operating means, which second member is arranged movably so that it can assume a first and a second position relative to the first member, wherein in the first position the tool-connecting means is connectable, at least when the first and second wellstring parts are interconnected, to the second wellstring part without operating the wellstring-interconnecting means, and wherein after connecting the auxiliary tool to the second wellstring part the wellstring-interconnecting means can be operated by moving the second member including the operating means between the first and the second position.

The present invention starts from the insight that the auxiliary tool has to perform two functions. First, the auxiliary tool needs to be connected to the second (lower) wellstring part. Secondly, the wellstring-interconnecting means (e.g. a bit connecting means which connects the closure element to the bit body) needs to be operated so as to disconnect the wellstring parts from each other. It was further realized that the robustness of the manipulation of the second wellstring part (e.g. the closure element) using the auxiliary tool can be increased, if the two functions of the auxiliary tool are decoupled from each other in a specific way, so that the wellstring-interconnecting means can only be operated when the auxiliary tool is connected to the second wellstring part. In this way it is prevented that the second wellstring part can be lost in the wellbore, since it can only be disconnected from the upper first wellstring part if it is fully connected to the auxiliary tool. When the opening up of the weUstring is reversed, after an operation in the open wellbore has been performed, the auxiliary tool can only be removed when the wellstring parts are properly interconnected again.

The invention achieves the decoupling of functions in that the auxiliary tool comprises first and second members, each of which is associated with mainly one of the functions, and which are movable relative to each other. In a first relative position between first and second members the auxiliary tool can be connected to the second wellstring part, and by moving the first and second members into their second relative position, the wellstring-interconnecting means is operated.

In a particular embodiment the wellstring assembly of the invention is a well-drilling bit assembly suitable for through-bit operation, wherein the wellstring element is a well-drilling bit, wherein the first wellstring part is a bit body attachable at its upper end to a tubular drill string, and wherein the passageway extends between an opening at the upper end and the exterior of the bit body; wherein the second wellstring part is a closure element for the passageway; and wherein the wellstring interconnection means is a bit-connecting means for releasably connecting the closure element to the bit body so as to selectively close the passageway.

In another particular embodiment the first wellstring part comprises a tubular wellstring having upper and lower ends, and the second wellstring part comprises a wellstring having upper and lower ends, which upper end is arranged to co-operate with the auxiliary tool and with the lower end of the first wellstring part, and which lower end is attachable to a well-drilling bit. In this embodiment the first and second wellstring parts form a wellstring which can be telescopically opened and closed above the well-drilling bit.

In an advantageous embodiment of the auxiliary tool, the tool-connecting means is arranged near the downstream end of the first member, the operating means is arranged near the downstream end of the second member, and the second member is arranged longitudinally slideably along the passageway with respect to the first member. Suitably then in the first relative position the second member is in an upstream position with respect to the first member, and the second member is moved in downstream direction when moving it towards the second relative position.

This embodiment is advantageous because it allows simple operation of the wellstring-interconnecting means by longitudinal motions alone. By lowering the auxiliary tool with the second member in the first relative position, the auxiliary tool can connect to the second wellstring part. With a further longitudinal motion of the second member with respect to the first member, the wellstring-interconnecting means can be operated. Such a longitudinal motion can easily be induced.

Suitably the passageway upstream of the second wellstring part and/or the auxiliary tool are provided with an orienting device for angularly orienting the auxiliary tool, so that a fail safe operation can be further ensured by bringing auxiliary tool and second wellstring part in a predetermined angular orientation with respect to each other at the moment of connecting (on order to open the passageway) and also in a predetermined angular position for closing the passageway again. The term angular orienting is used in relation to a rotation about the longitudinal axis of the wellstring, and the angle is in the transverse plane. Suitably, to this end, the auxiliary tool at its outer wall is provided with an outwardly projecting key, and the inner wall of the passageway is provided with two guiding rims forming a central guiding groove through which the key can pass, the guiding groove having upstream and downstream ends, further with an upstream camming rim extending from a position upstream of the guiding groove to the upstream end of the guiding groove fully around the inner wall, and with a downstream camming rim extending from a position downstream of the guiding groove to the downstream end of the guiding groove fully around the inner wall, wherein the camming rims and the guiding rims project sufficiently into the passageway so as to engage, when the auxiliary tool is moved through the passageway, the key and to guide the key into the guiding groove, thereby angularly orienting the auxiliary tool. Alternatively, the camming rims and guiding groove can also be provided on the circumference of the auxiliary tool, and a key on the inner surface of the passageway.

The tool-connecting means of the auxiliary tool and the co-operating part of the closure element are further suitably shaped such that only in the correct predetermined relative angular position between them, as determined by the orienting device, connecting/disconnecting of the auxiliary tool to/from the second wellstring part, and further operation of the wellstring-interconnecting means is possible.

BRIEF DESCRIPTION OF THE DRAWINGS

The invention and advantages thereof will be discussed in more detail and with reference to the Figures, wherein.

DETAILED DESCRIPTION OF THE INVENTION

A first embodiment of the invention will be discussed with reference to FIGS. 1-7. In this embodiment the wellstring assembly is a well-drilling bit assembly suitable for through-bit operation, the wellstring element is a well-drilling bit, the first wellstring part is a bit body provided with a passageway, the second wellstring part is a closure element for the passageway; and the wellstring interconnection means is a bit-connecting means for releasably connecting the closure element to the bit body so as to selectively close the passageway.

Figure 1:
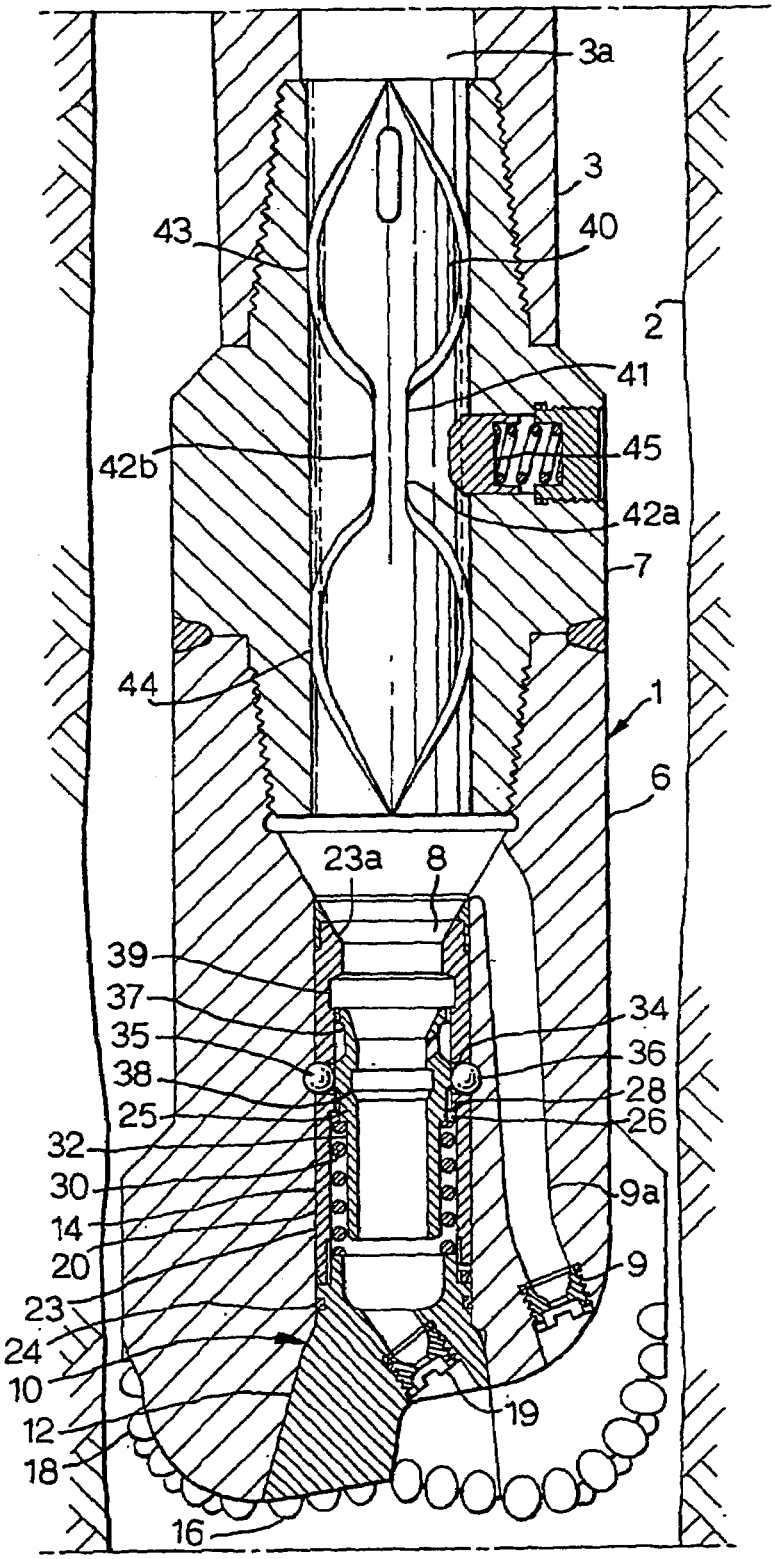
FIG. 1 shows schematically a first embodiment of a wellstring element according to the present invention.

Reference is made to FIG. 1, showing a longitudinal cross-section of a well drilling bit 1 for through-bit operation, which bit is suitable for use with the present invention. The well drilling bit 1 is shown in the borehole 2, and is attached to the lower end of a drill string 3. The well drilling bit 1 comprises a bit body 6 including a bit shank 7 which together form a central longitudinal passageway 8 for a tool, between the interior 3*a* of the drill string 3 and the borehole 2 exterior of the well drilling bit 1, as will be pointed out in more detail below. Bit nozzles are arranged in the bit body 6. Only one nozzle 9 is shown for the sake of clarity. The nozzle 9 is connected to the passageway 8 via the nozzle channel 9*a*.

The well drilling bit 1 is further provided with a removable closure element 10, which is shown in FIG. 1 in its closing position with respect to the passageway 8. The closure element 10 of this example includes a central insert section 12 and a latching section 14. The insert section 12 is provided with cutting elements 16 at its front end, wherein the cutting elements are arranged so as to form, in the closing position, a joint bit face together with the cutters 18 at the front end of the bit body 6. The cutting elements 16 and 18 can be polycrystalline diamond cutters. The insert section is also provided with nozzles 19. Further, the insert section and the cooperating surface of the bit body 6 are shaped suitably so as to allow transmission of drilling torque from the drill string 3 and bit body 6 to the insert section 12.

The latching section 14, which is fixedly attached to the rear end of the insert section 12, has substantially cylindrical shape and extends into a central longitudinal bore 20 in the bit body 6 with narrow clearance. The bore 20 forms part of the passageway 8, it also provides fluid communication to nozzles in the insert section 12.

Via the latching section 14 the closure element 10 is removably attached to the bit body 6. The latching section 14 of the closure element 10 comprises a substantially cylindrical outer sleeve 23 which extends with narrow clearance along the bore 20. A sealing ring 24 is arranged in a groove around the circumference of the outer sleeve 23, to prevent fluid communication along the outer surface of the latching section 14. Connected to the lower end of the sleeve 23 is the insert section 12. The latching section 14 further comprises an inner sleeve 25, which slidingly fits into the outer sleeve 23. The inner sleeve 25 is provided with an annular rim 26, which is biased in upstream direction against an inward shoulder 28 of the outer sleeve 23. The biasing force is exerted by a partly compressed helical spring 30, which pushes the inner sleeve 25 away from the insert section 12. At its lower end the inner sleeve 25 is provided with an annular recess 32 which is arranged to embrace the upper part of spring 30.

The outer sleeve 23 is provided with recesses 34 wherein locking balls 35 are arranged. A locking ball 35 has a larger diameter than the thickness of the wall of the sleeve 23, and each recess 34 is arranged to hold the respective ball 35 loosely so that it can move a limited distance radially in and out of the sleeve 23. Two locking balls 35 are shown in the drawing, however it will be clear that more locking balls can be arranged. As an alternative for locking balls, locking dogs can be used.

In the closing position as shown in FIG. 1 the locking balls 35 are pushed radially outwardly by the inner sleeve 25, and register with the annular recess 36 arranged in the bit body 6 around the bore 20. In this way the closure element 10 is locked to the well drilling bit 1, and the locking balls 35 together with the groove 36 form part of a bit-connecting means for connecting the closure element 10 to the bit body 6.

The inner sleeve 25 is further provided with an annular recess 37, which is, in the closing position, longitudinally displaced with respect to the recess 36 in the direction of the drill string 3, i.e. in upstream direction. There can also be provided inner recesses 38. As will be explained in more detail below, the bit-connecting means can be operated by inducing a longitudinal motion of the inner sleeve 25 with respect to the outer sleeve 23, because in this way the locking balls 36 can be locked into and released from the groove 36.

The upstream end 23*a* of the outer sleeve 23 is funnel-shaped so as to guide an auxiliary tool into the latching section 14, which auxiliary tools serves to connect to the closure element and to operate the bit-connecting means. Latching recesses 39 are arranged in the outer sleeve 23, and co-operate with a tool-connecting means of the auxiliary tool.

The latching section 14 further comprises a two-way orienting device 40 and a spring-biased activation button 45, which are both arranged to co-operate with an auxiliary tool which can be deployed through the interior of the drill string for manipulating the closure element 10. The orienting device 40 comprises a guiding groove 41 formed by inwardly extending rims 42*a*, 42*b*, which extend in upstream and downstream direction fully around the circumference of the passage 8, to form an upstream camming rim 43 and a downstream camming rim 44. The orienting device 40 is drawn as shown in FIG. 1 for the sake of clarity, suitably however it is oriented such that the guiding groove 41 is arranged opposite the button 45.

An embodiment of the auxiliary tool will now be discussed.

Figure 2:
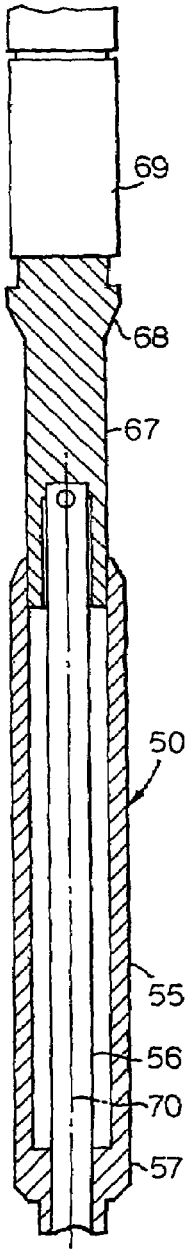
FIG. 2 shows schematically the upstream part of an auxiliary tool according to the invention.
Figure 4:
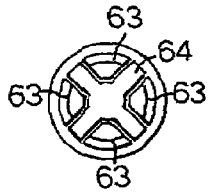
FIG. 4 shows schematically a cross-section taken at IV-IV in FIG. 3.
Figure 3:
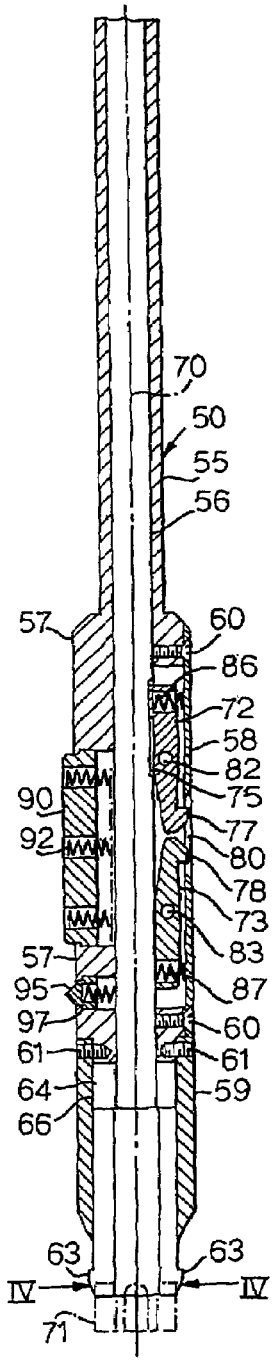
FIG. 3 shows schematically the downstream part of an auxiliary tool according to the invention.

Reference is made to FIGS. 2-4. FIG. 2 shows schematically the upstream part of an auxiliary tool, and FIG. 3 the downstream part of an auxiliary tool according to the invention in longitudinal cross-section. FIG. 4 shows a cross-section taken at IV-IV in FIG. 3.

The auxiliary tool 50 for manipulating the closure element 10 is arranged so that it can pass from surface through the interior of the drill string 3, along the passageway to the closure element 10, when the closure element is connected to the bit body 6 as shown in FIG. 1. To this end the auxiliary tool is elongated and substantially cylindrical having a maximum outer diameter of less than the inner diameter of the drill string 3. The most downstream part of the auxiliary tool which has to pass into and possibly through the drill bit has a maximum outer diameter of less than the minimum diameter of the passageway. A typical minimum diameter of the passageway is 6 cm (2.5 inch), when the drilling bit 1 has a diameter of as low as 15 cm (6 inch), or 21 cm (8.5 inch), or 31 cm (12.25 inch).

The auxiliary tool comprises a first, outer member 55 and a second member in the form of inner piston 56. The outer member 55 of this example has a housing formed by parts 57,58,59, which are assembled by screws 60,61. The outer member 55 includes a tool-connecting means at its most downstream end. The tool-connecting means includes four latching petals 63, which are arranged to co-operate with the latching recesses 39 in the latching section 14 of the closure element 10, so as to selectively and releasably connect the auxiliary tool to the closure element.

The inner piston 56 is provided with an operating means at its downstream end, in the form of a plunger 64. The plunger 64 has a cross-shaped cross-section at its most downstream end, as is best visible in FIG. 4, and serves to longitudinally shift the inner sleeve 25 with respect to the outer sleeve 23 of the latching section. To this end the inner piston 56 is longitudinally movable with respect to the outer member 55. The plunger 64 is shown at 66 in a first, retracted position. This position at the same time characterizes the relative position between the first, outer member 56 and the inner piston (second member) 56. This is also visible from the upstream part of the auxiliary tool 50 in FIG. 2, wherein the shaft 67 that is connected to the upper part of the inner piston 56 is fully retracted from the upper part of the outer member 55. The shaft 67 has a shoulder 68, and is connected via a swivel 69 to other equipment (not shown) such as tubing or a logging tool. The swivel allows rotation of such other equipment with respect to the auxiliary tool.

With the plunger in this retracted position, the latching petals 63 of the outer member 55 have transverse flexibility towards the axis 70 of the auxiliary tool, so that they can enter into the latching section 14 and connect into the latching recesses 39. The inner piston 56 can also be longitudinally moved to assume other positions relative to the outer member 55. One such position is indicated dashed at 71, and in this position the petals 63 cannot flex anymore towards the axis.

The plunger 64 is arranged so that it can push onto the upper end of the inner sleeve, thereby forming an operating means for the bit-connecting means as discussed before.

This will be discussed in more detail with respect to FIGS. 5-7.

The auxiliary tool is further provided with several parts that even further support fail-safe operation: Upstream trigger 72 forming a first retaining device and downstream trigger 73 forming a second retaining device are arranged on the outer member 55 to co-operate with a recess 75 on the inner piston 56 and with the button 45 of the bit body 6, as will be explained in more detail below. The triggers 72 and 73 are provided with notches 77, 78 extending through an opening 80 in the housing 58, and are pivotably mounted about axes 82,83, wherein the ends opposite the notches are biased in the direction of the inner piston 56 by means of a spring 86,87.

The housing is further provided with a key 90 projecting out of the substantially cylindrical outer surface of the downstream part of the outer member 55, co-operating with the two-way orienting tool 40 of the bit body 6. The key 90 is elongated, parallel to the direction of the axis 70, and has tapered edges giving it a boat-like shape. The key is supported by springs 92. Instead of a boat-shaped elongated key also two separate keys that are longitudinally spaced apart can be arranged. Downstream of the key 90 and slightly angularly displaced there is an anti-collision button in the form of a radially outwardly extending tip 95 supported by a spring 97.

The inner piston 56 can further be provided with fingers (not shown for the sake of clarity) extending more downstream than the plunger 64, which fingers can co-operate with recesses 38 in the closure element 10. In this way, also the inner piston can be connected to the insert section in a predetermined position, which can further contribute to fail-safe operation in the event of strong longitudinally outward forces on the insert section 12 due to pulling or pumping.

Figure 5:
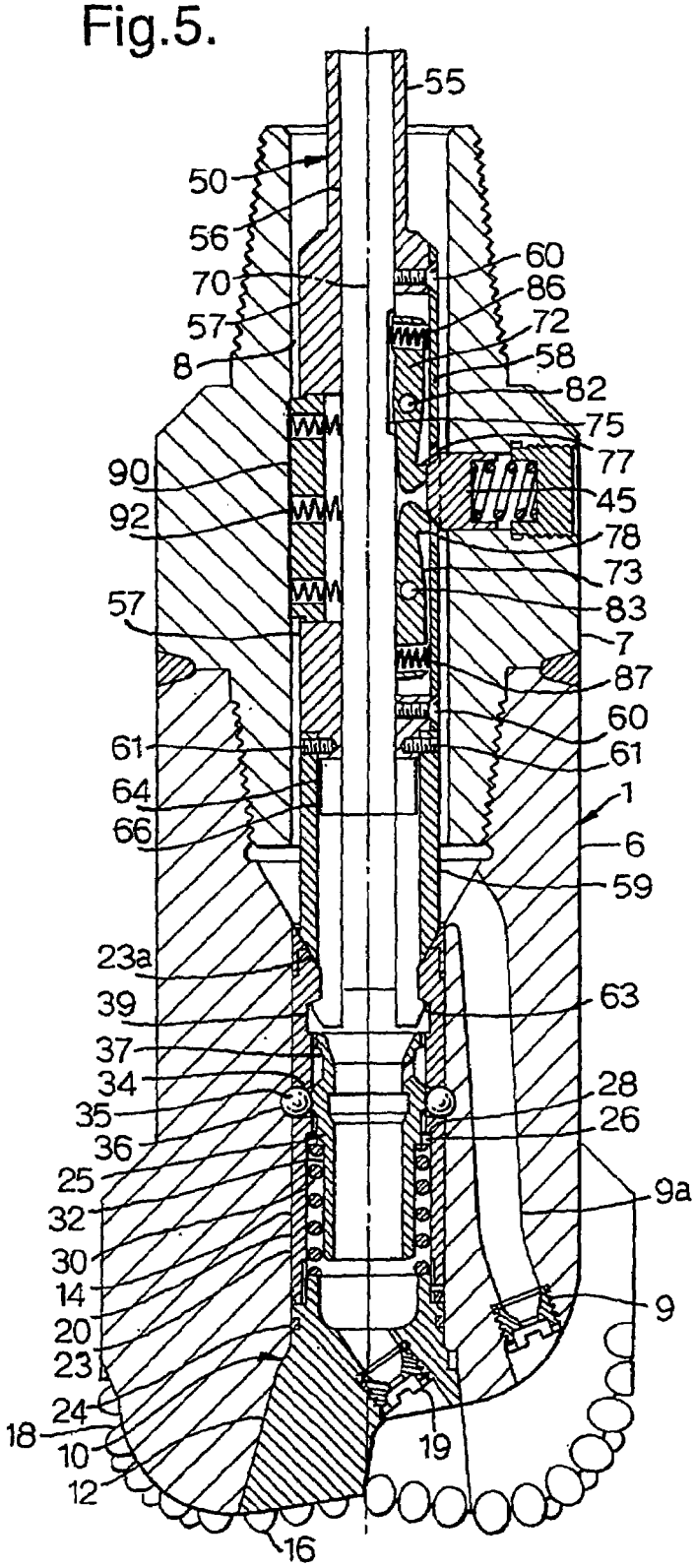
FIG. 5 shows schematically the interaction between auxiliary tool and well drilling bit in a first situation.
Figure 6:
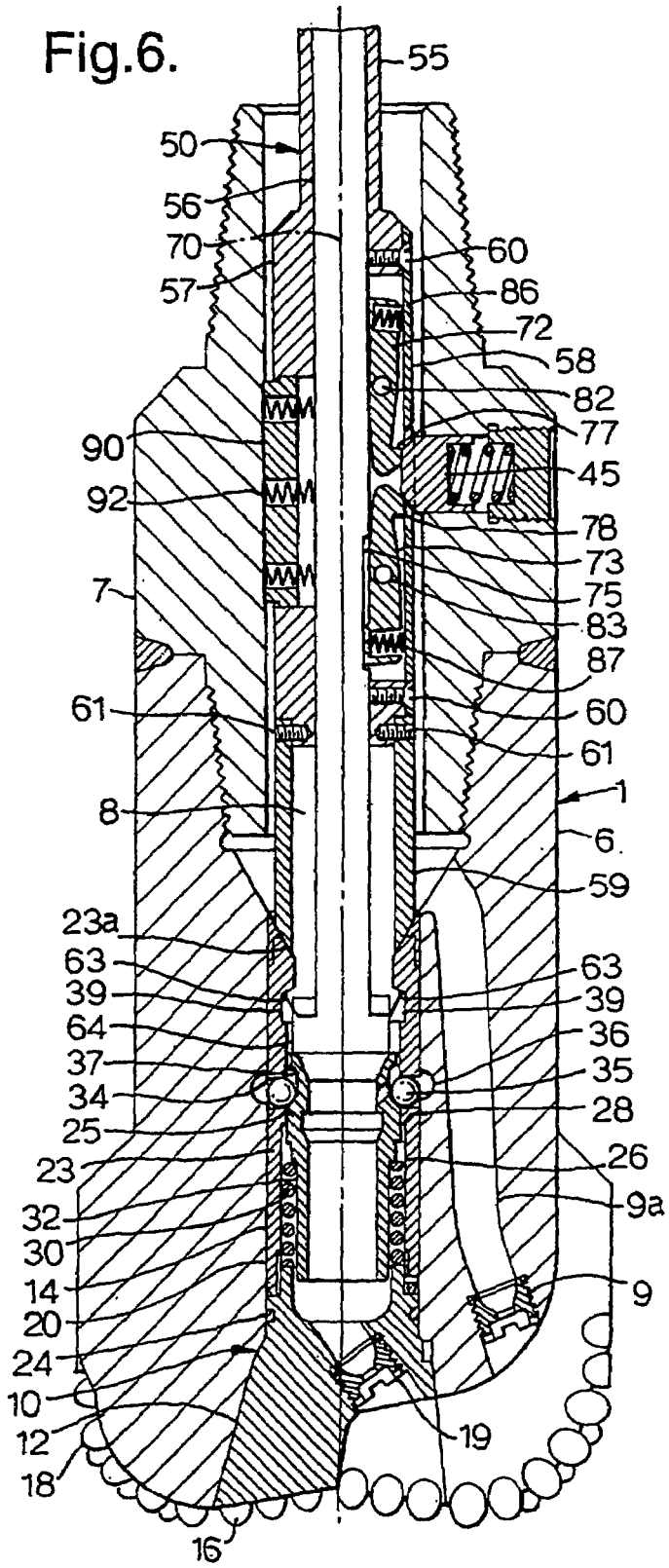
FIG. 6 shows schematically the interaction between auxiliary tool and well drilling bit in a second situation.
Figure 7:
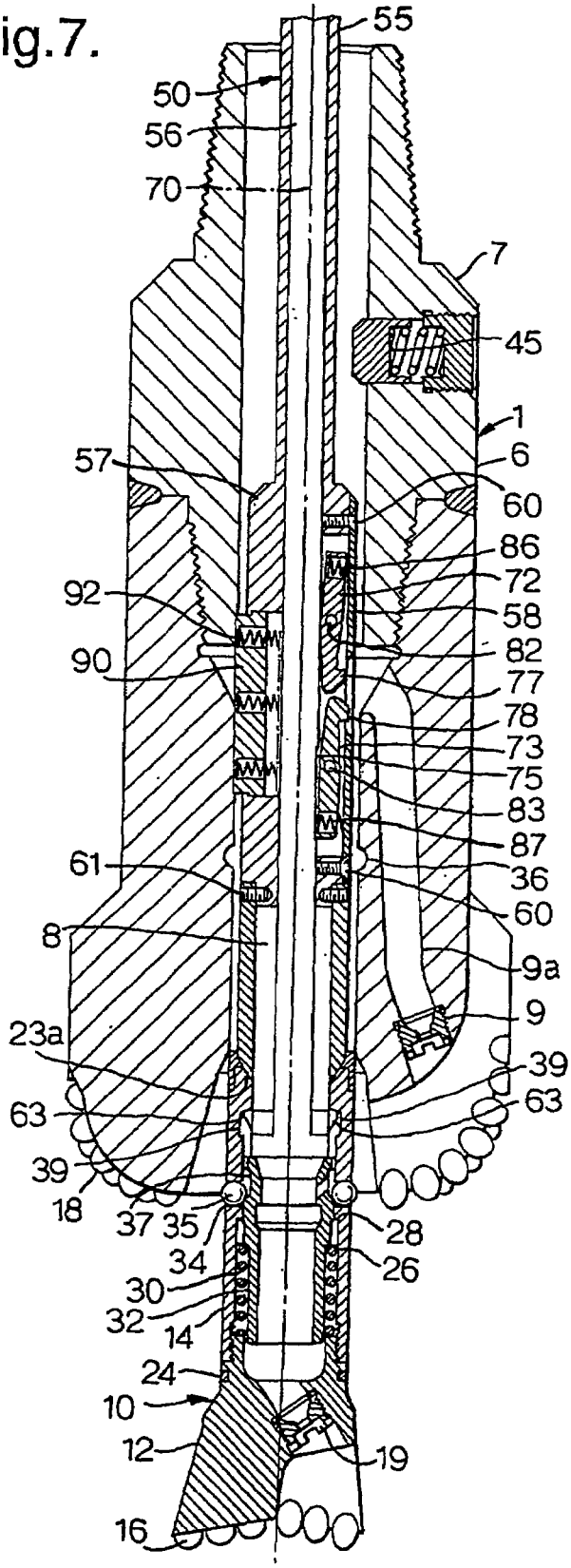
FIG. 7 shows schematically the interaction between auxiliary tool and well drilling bit in a third situation.

The function of the parts to ensure fail-safe operation will become clear from the discussion of FIGS. 5-7.

Reference is made to FIG. 5-7 showing several stages of the interaction between the auxiliary tool and the well drilling bit and interconnection means 18. Reference numerals correspond to those already used in connection with FIGS. 1-4.

The well drilling bit 1 with the closure element 10 in the closing position as shown in FIG. 1 can be used for progressing the wellbore 2.

The well drilling bit 1 with the closure element 10 in the closing position as shown in FIG. 1 has the shape and full functionality of a conventional PDC well drilling bit and can thus be used for normal drilling operation in the same way as well known in the art, e.g. by rotating the drill string 3 and putting weight on the bit.

When it is desired to open the passageway 8 by removing the closure element 10 from its closing position, the well drilling bit is first positioned a distance above the bottom of the borehole. Then, the closure element 10 can be outwardly removed from the closing position in the well drilling bit 1.

To this end, the auxiliary tool 50 is lowered from surface or from a position inside the drill string 3 along the passageway 8 from the drill string through the opening of the drill string side of the bit body into the bit body 6.

When lowering the auxiliary tool 50, the inner piston 56 is in its retracted position 66, which is also referred to as the first position relative to the outer member 56 in the specification and in the claims. When the lower part of the auxiliary tool enters the bit body 6, the key 90 engages the upstream camming rim 43 (not shown in FIGS. 5-7 for the sake of clarity) and the auxiliary tool is turned about the swivel 69 so that a predetermined angular position between the tool-connecting means and the latching section 14 is achieved just before the point where the auxiliary tool contacts the latching section 14.

The petals 63, forming the tool-connecting means on the downstream end of the outer member 56, are received and guided by the funnel-shaped upstream end 23*a* of the outer sleeve 23 into the latching section 14. The legs of the petals 63 are inwardly deformed until the petals 63 register with the recesses 39 so that they can snap outwardly. This position, wherein the auxiliary tool 50 is connected to the closure element 10 is shown in FIG. 5.

It is also clear from the drawing that the button 45 has engaged the notch 77 of the upstream trigger 72 (which forms a first retainer device), thereby lifting the upstream end of the trigger 72 out of the recess 75. Therefore, when the petals 63 have connected into the recesses 39, the first retainer device 72 is operated (released) so that it does not block anymore downstream motion of the inner piston 56.

Further pushing on the upstream end of the auxiliary tool 50 will cause the inner piston 56 to slide longitudinally relative to the outer member 55. The plunger 64 engages the upstream end of the inner sleeve 25, which has a smaller inner diameter than the diameter of the plunger 64. Further downstream motion of the inner piston causes the inner sleeve to be pushed against the force of the spring 30, until the locking balls 35 register with the recesses 37. This situation is shown in FIG. 6. The locking balls are therefore allowed to move inwardly, thereby unlocking the closure element from annular recess 36, i.e. from the bit body. In this way the plunger 64 forms an operating means for the bit-connecting means. The relative position between the inner piston 56 and the outer member 55 at which the locking balls are fully released from the annular recess 36 is referred to as the second relative position in the specification and in the claims.

In the position shown in FIG. 6, the inner piston 56 prevents inward flexing of the petals 63, so that the auxiliary tool 50 is securely locked to the closure element 10. Also, in this position the recess 75 on the inner piston has moved so far that it registers with the downstream trigger 73 (second retainer device). The downstream end of the downstream trigger 73 is forced into the recess 75 by the action of the spring 87, and blocks the longitudinal upstream motion of the inner piston 56 with respect to the outer member 56 when the closure element 10 is unlatched.

By further pushing on the auxiliary tool 50 in downstream direction the closure element 10 is outwardly removed from the bit body 6. This is shown in FIG. 7. Suitably the auxiliary tool can be hung off in the bottom hole assembly, so that it can easily be retrieved. The auxiliary tool can for example be mounted on the lower end of a logging tool, so that the logging tool can in this way be passed into the open borehole ahead of the bit body 6, where logging measurements can be performed. If instead of a logging tool a fluid injection tool is used, fluid injection operations can be performed in the borehole, e.g. cementing, injection of lost circulation material, or jet cleaning of the borehole wall or of the bit cutters.

The well drilling bit 1 and auxiliary tool 50 are such designed that the closure element 10 can be re-latched to the bit body 6 if that is desired.

When starting from the situation depicted in FIG. 7, when the auxiliary tool is pulled in upstream direction, the downstream trigger 73 interacting with the recess 75 keeps the inner piston in the position relative to the outer member 55 as shown.

The key 90 interacts with the downstream camming rim 44 (which is only shown in FIG. 1 for the sake of clarity) so as to bring the closure element 10 with attached auxiliary tool 50 into a predetermined angular orientation with respect to the bit body 6. This predetermined angular orientation needs to be provided at a different, lower position of the auxiliary tool than before, when the auxiliary tool was to engage and connect to the closure element 10. To this end the key 90 is elongated, or two keys are arranged at a suitable longitudinal spacing. In this way orientation occurs at different longitudinal positions. This could in principle also be achieved by making the guiding groove 41 longer. The advantage of the elongated key means is that less space is needed for the orienting device 40 as part of the wellstring or drilling bit. The elongation of the key means can be chosen longer than the length of the guiding groove.

When the position shown in FIG. 6 is reached, the locking balls 35 are about to be forced back into the annular recess 36. At this position, the button 45 activates the downstream trigger 73 so that it is released from the recess 75, and the inner piston 56 including the plunger 64 at its downstream end can be moved in upstream direction. The inner sleeve 25 including the recesses 37 shifts upwardly, and the locking balls are locked again into the annular recess 36. At this stage the bit body and closure element are interconnected again.

After interconnecting, the auxiliary tool can be disconnected again from the closure element. To this end the inner piston is moved to the position relative to the outer member as shown in FIG. 5, and no longer blocks inward flexing motion of the petals 63. Therefore, by further pulling the auxiliary tool up, e.g. from surface, the petals 93 disengage from the recesses 39, and to this end the upstream edges are slightly bevelled as shown in the drawing. After pulling slightly further, the button 45 disengages from the upstream trigger 72 which will subsequently prevent the inner piston from moving in downstream direction again.

As shall be clear from the foregoing discussion, the present invention allows fail-safe removal of the closure element of a well drilling bit, by simply passing/pushing the auxiliary tool down the drill string (e.g. by using tubing extending to surface or pumping). The invention in particular prevents that the closure element can be lost in the well bore. Also, fail-safe re-connecting is possible by simply passing/pulling the auxiliary tool up again (e.g. by tubing or wireline).

An alternative embodiment of the present invention will now be discussed. This embodiment relates to a wellstring assembly suitable for performing an operation (such as drilling) in relation to a borehole and/or earth formation external of the wellstring in the borehole, in the course of which operation, it is desired to have access to the borehole exterior of the wellstring. Different from the embodiment discussed with reference to FIGS. 1-7, the present embodiment does not require a special well-drilling bit, in that access to the borehole can be provided by opening up the wellstring above the drill bit. Operations in the open borehole outside of the wellstring can be performed through the opening at the lower end of the upper part of the wellstring assembly.

Figure 8:
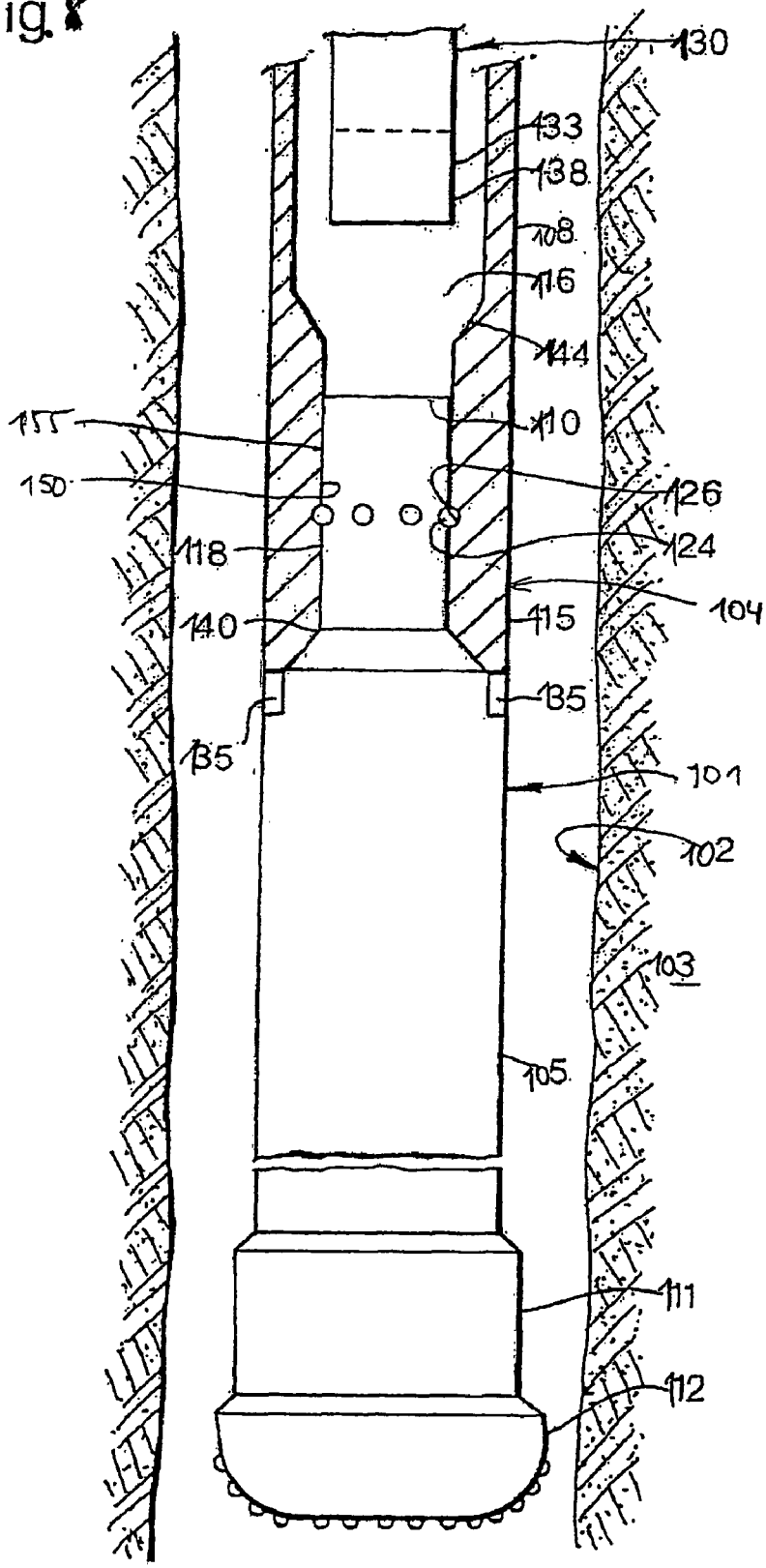
FIG. 8 shows schematically a second embodiment of a wellstring element according to the invention, wherein the first and second wellstring parts are interconnected.

Reference is made to FIG. 8, showing schematically a wellstring assembly 101 according to the invention when arranged in a borehole 102 penetrating a subsurface formation 103. In FIG. 8 a first and second wellstring part of a wellstring element 104 are shown connected to each other. The first wellstring part will hereafter also be referred to as the upper wellstring part 108 and the second wellstring part as the lower wellstring part 105. The lower wellstring part 105 has an upper end 110 and a lower end 111, and at the lower end in this case a conventional drill bit 112 is attached. The lower wellstring part 105 can also include other elements of a bottom hole assembly such as a drill collar, directional steering devices, mud motor, measurement-while-drilling system (not shown). The lower wellstring part does not need to have a large diameter longitudinal passageway.

The upper wellstring part 108 has a lower end 115, and extends to surface so that its upper end is not shown in the Figure. The upper wellstring part 108 is tubular, so that a longitudinal passageway 116 is formed between its upper and lower ends.

The upper and lower wellstring parts are releasably interconnected by a wellstring interconnection means 118, which is formed by a latch mechanism of co-operating parts at the upper end 110 of the lower wellstring part 105 and the lower end 115 of the upper wellstring part 108. The latch mechanism is only schematically indicated in FIG. 8 by locking balls 124 on the lower wellstring part co-operating with a locking recess or recesses 126 inside the tubular upper wellstring part. The interconnecting means can suitably be analogous to the co-operating latching section 14 and bit body 6 described with reference to FIGS. 1-7.

The wellstring assembly 101 further comprises an auxiliary tool 130 that can be passed along the passageway 116 of the upper wellstring part 108, wherein the auxiliary tool 130 comprises an operating means 133 for manipulating the wellstring interconnection means 118 so as to disconnect the lower wellstring part 105 from the upper wellstring part 108. The auxiliary tool can suitably be analogous to the tool discussed with reference to FIGS. 2-4.

The upper and/or lower wellstring parts are provided with means 135 for rotationally locking the wellstring parts relative to each other when they are interconnected. This is needed in order to be able to transmit torque to the lower wellstring part by rotating the upper wellstring part. The locking means can have the form of one or more locking fingers or keys cooperating with a suitable recess on the other wellstring part.

Figure 9:
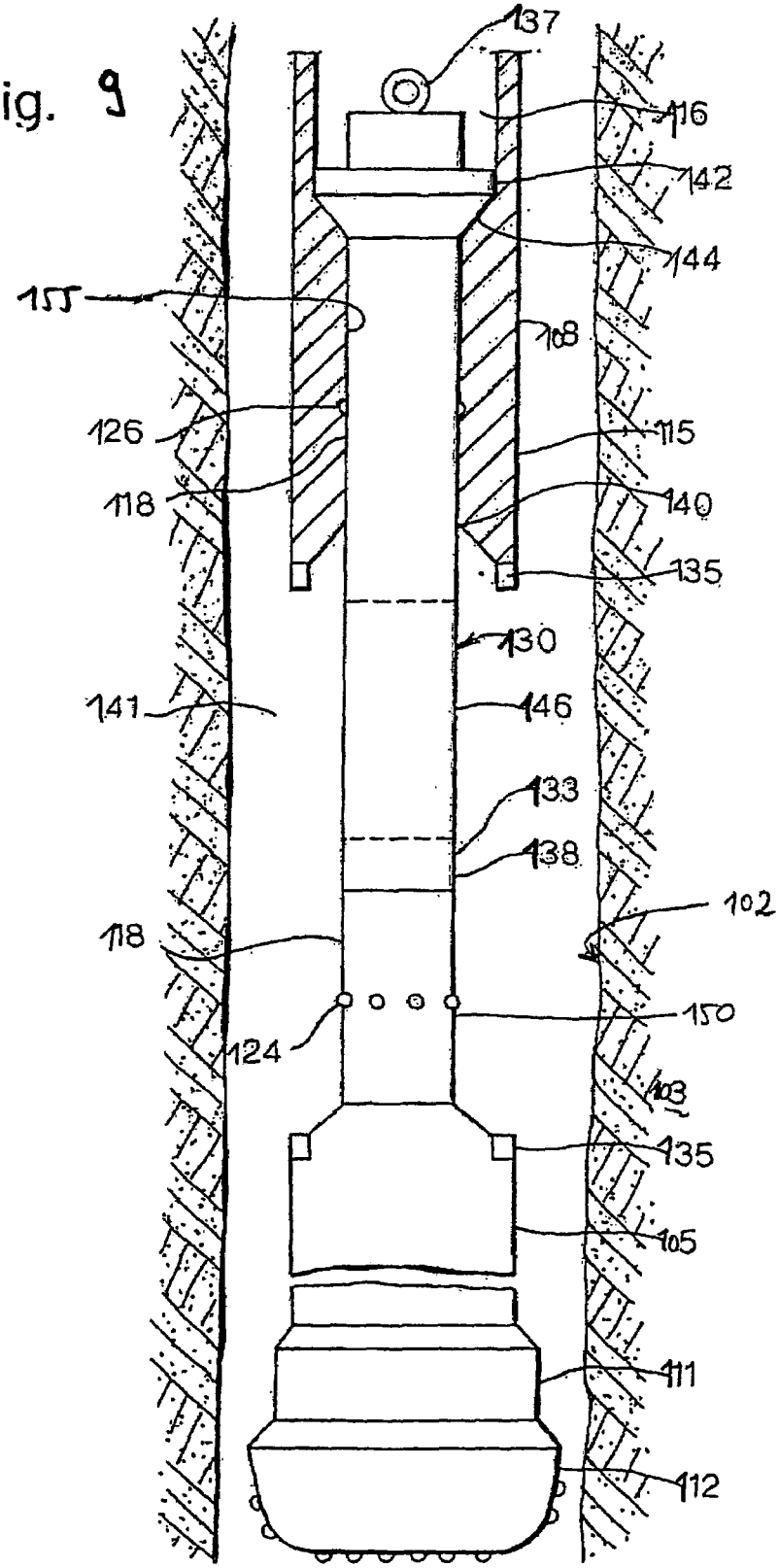
FIG. 9 shows the embodiment of FIG. 8 after the wellstring parts have been disconnected from each other.

Reference is made to FIG. 9, showing schematically the wellstring assembly 101 of FIG. 8 after the wellstring interconnection means 118 was operated by the auxiliary tool 130, by lowering the auxiliary tool. Lowering can be done by means of the fishing neck 137 by means of wireline or coiled tubing, or by using a special deployment tool such as a pumping tool.

The auxiliary tool 130 further comprises a tool-connecting means 138 which is arranged such that it connects the auxiliary tool 130 to the lower wellstring part 105, before disconnecting the wellstring interconnection means 118 by operating means 133. The tool-connecting means suitably operates fully analogous to that discussed with reference to FIGS. 1-7.

FIG. 9 shows the wellstring assembly 101 in a situation wherein the auxiliary tool 130 has been passed on through the opening 140 at the lower end of the upper wellstring part 108, to reach a working position as shown, wherein the auxiliary tool extends into a region 141 of the borehole 102 external of the wellstring, where part of the auxiliary tool is not radially surrounded by any of the wellstring parts.

To fix the auxiliary tool in the working position, the auxiliary tool is provided with a hang-off device in form of a landing ring 142 at its upper end, which landing ring co-operates with a landing shoulder 144 in the upper wellstring part 108.

The auxiliary tool 130 further comprises a logging tool 146 on the part that is not surrounded by the wellstring 101 when the wellstring has been opened up and the auxiliary tool is in the working position as shown. It shall be clear, that instead of a logging tool 146 also another means for performing an operation in relation to the borehole or formation surrounding the auxiliary tool can be arranged. Alternatively, the part indicated with reference numeral 146 only provides an opening or window (not shown) through which a further specialised tool can operate, which further specialised tool is lowered into the auxiliary tool.

Figure 10:
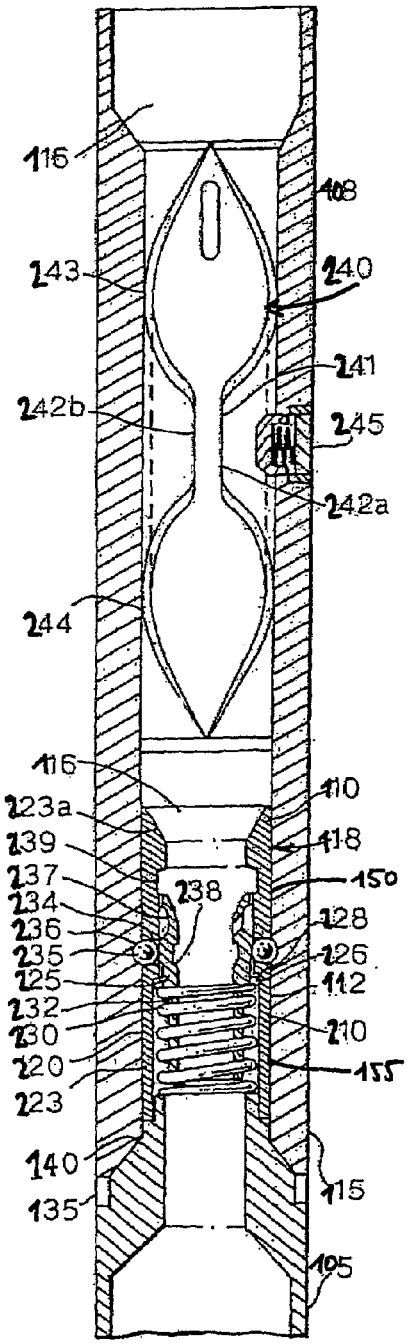
FIG. 10 shows schematically the interconnection means of the second embodiment.

FIG. 10 shows an example of the wellstring interconnection means 118 in more detail in longitudinal cross-section, when the upper and lower well string parts are interconnected as in FIG. 8. The interconnection means 118 is formed by a latching device 150 at the upper end 110 of the lower well string part 105, co-operating with a section 155 at the lower end 115 of the upper well string part 108.

As embodiment of the auxiliary tool 130 for use with the present embodiment the auxiliary tool 30 discussed in detail above will be referred to. Reference will also be made to other reference numerals introduced with reference to FIGS. 2-4.

Figure 11:
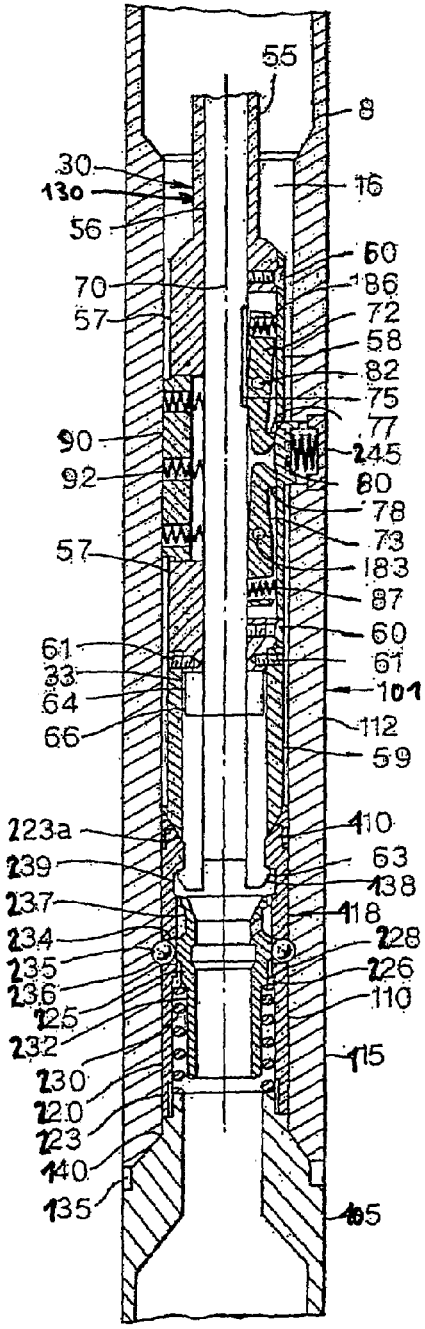
FIGS. 11-13 show schematically several situations of the interaction between wellstring parts and auxiliary tool in the second embodiment.
Figure 12:
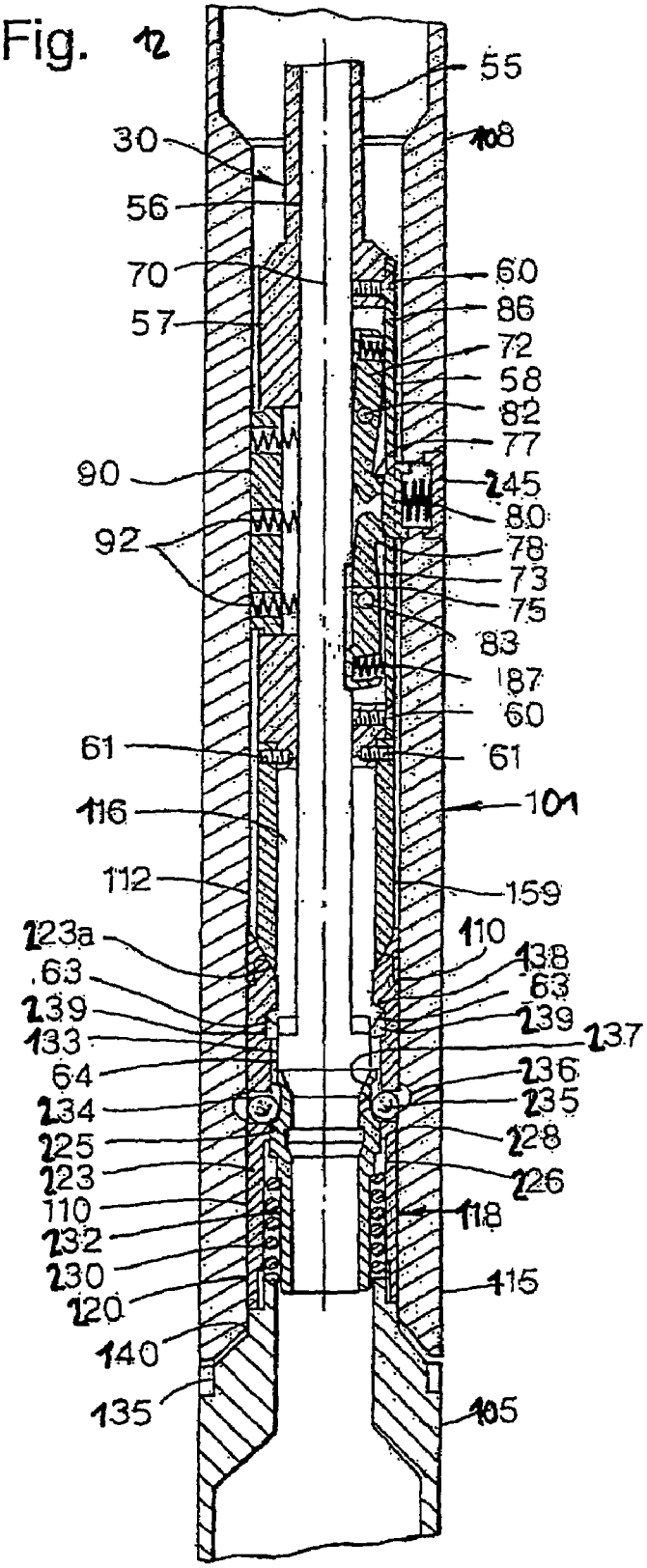
Figure 13:
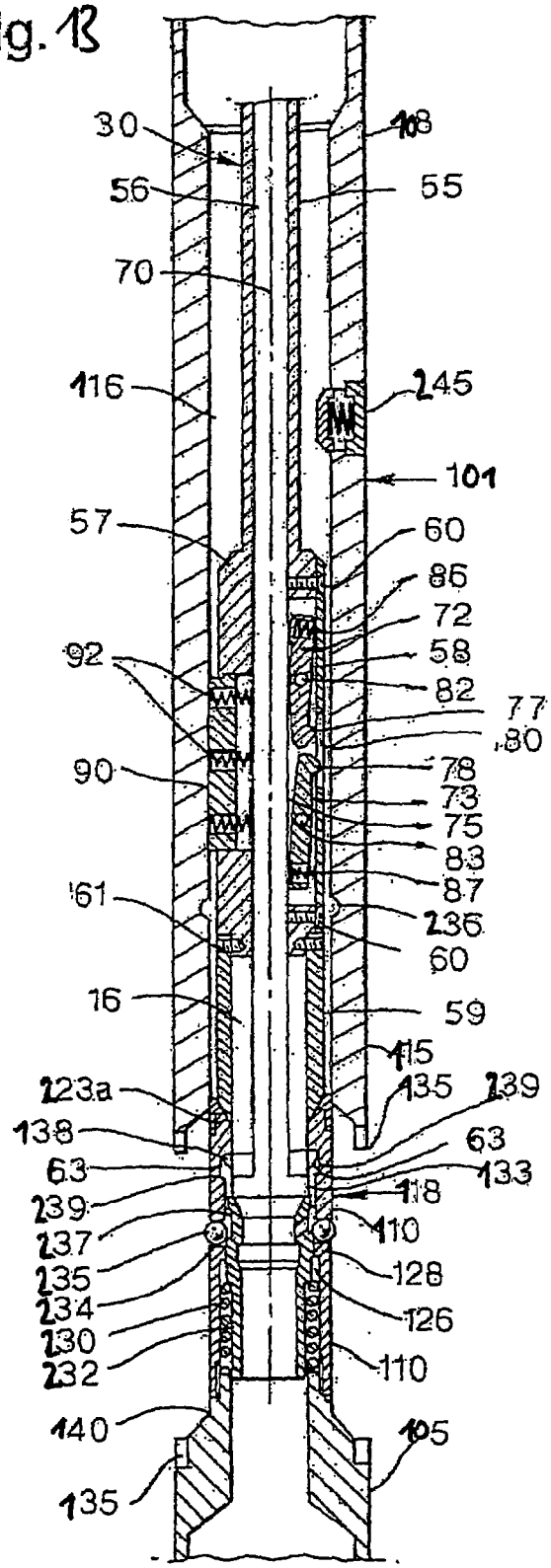

FIGS. 11-13 show several stages of the interaction between the auxiliary tool 30 and the interconnection means 118 when the interconnection means is operated so as to disconnect the upper and lower well string parts.

The operation and interaction of the upper and lower well string parts, interconnection means 118 and auxiliary tool 30 of the embodiment depicted in FIGS. 8-13 is analogous to the operation of the bit body, closure element, bit-connecting means and auxiliary tool discussed with reference to FIGS. 1-7. This will be easily understood since reference numerals above 200 in FIGS. 10-13 have been chosen such that they refer to parts that have the same or similar function as the corresponding reference numerals lower than 100 in FIGS. 1-7. Reference numerals in FIGS. 10-16 between 100 and 200 correspond to those used in connection with FIGS. 8-9.

Operation of the wellstring assembly 101 is fully analogous to the operation of the well drilling bit discussed with reference to FIGS. 1-7, wherein the upper wellstring part and lower wellstring part play a role analogous to the bit body and closure element, respectively.

When it is desired to perform an operation in the open borehole 102, the drill bit 112 is first positioned a distance above the bottom of the borehole. Then, the auxiliary tool 30 is lowered through the upper wellstring part 108 with the inner piston 56 in the retracted position as in FIG. 11. The orientation means 240 and key interact for correct angular orientation, and the tool-connecting means (petals 63) engages and connects to the co-operating part of the lower wellstring part 105. Then the wellstring interconnection means is operated by moving the inner piston to the second, extended position as shown in FIG. 12. FIG. 13 shows the situation wherein the upper and lower wellstring parts have been disconnected, but wherein the auxiliary tool 30 is connected to and holds the lower wellstring part 105. In this situation part of the auxiliary tool reaches the open borehole and is not radially surrounded by the well string, so that an operation can be performed as discussed with reference to FIG. 9. By retracting the auxiliary tool 30 again, the tool is first re-oriented for proper re-connection, then the wellstring interconnection means is operated so as to reconnect upper and lower wellstring parts, and finally the auxiliary tool can be disconnected from the lower wellstring part again.

The wellstring according to the present embodiment does not need to be provided with a drill bit at the lower end of the lower well string part. A reamer can for example be mounted, or a cementing tool. In a particular application the lower end of the lower well string part is formed by a jetting head and the lower part of the well string in this case further includes a knuckle joint. Jetting head and knuckle joint are used in re-entry systems to direct a well string into a particular branch of a multilateral well.

Figure 14:
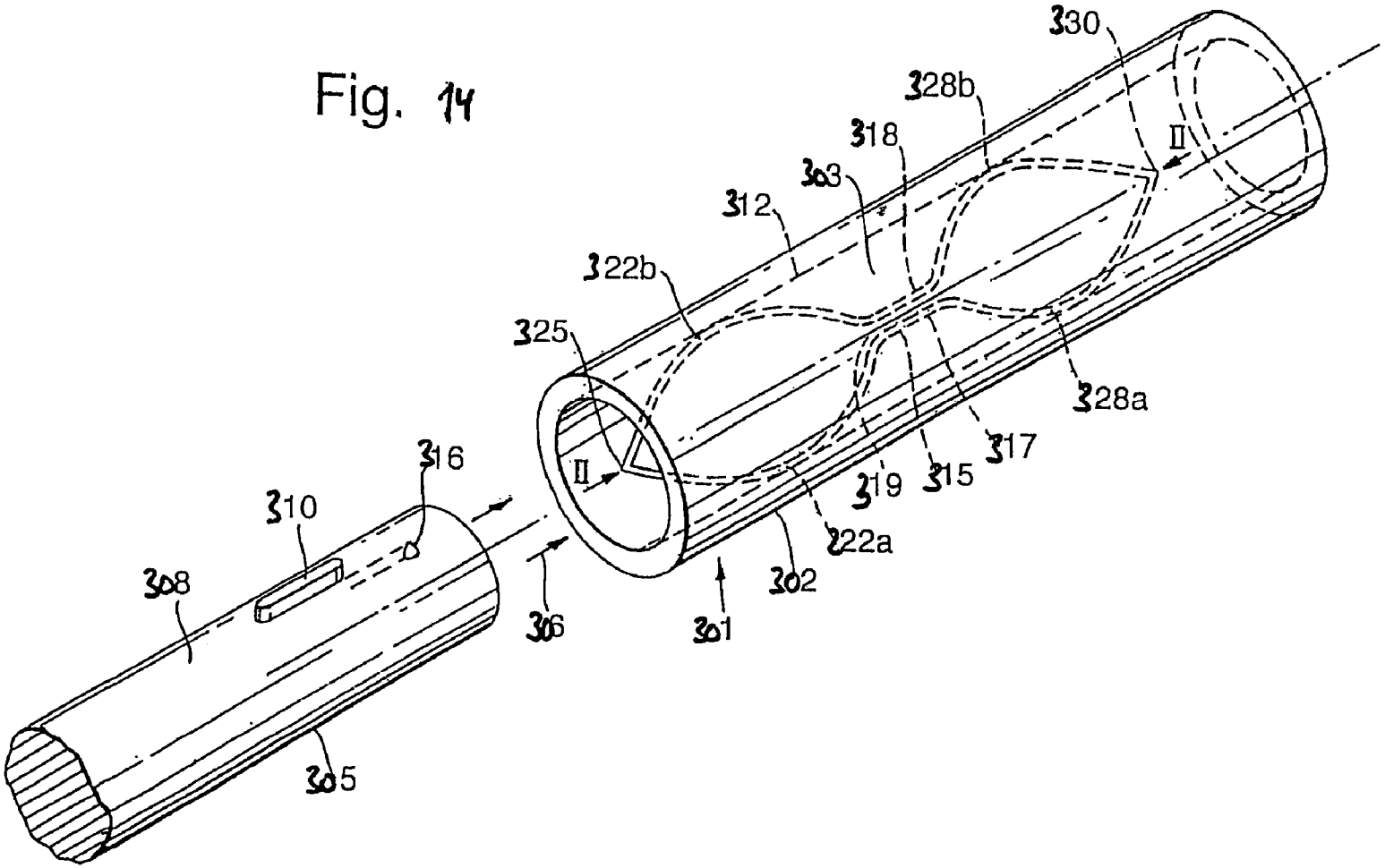
FIG. 14 shows schematically an embodiment of an orienting device for use with the present invention.
Figure 15:
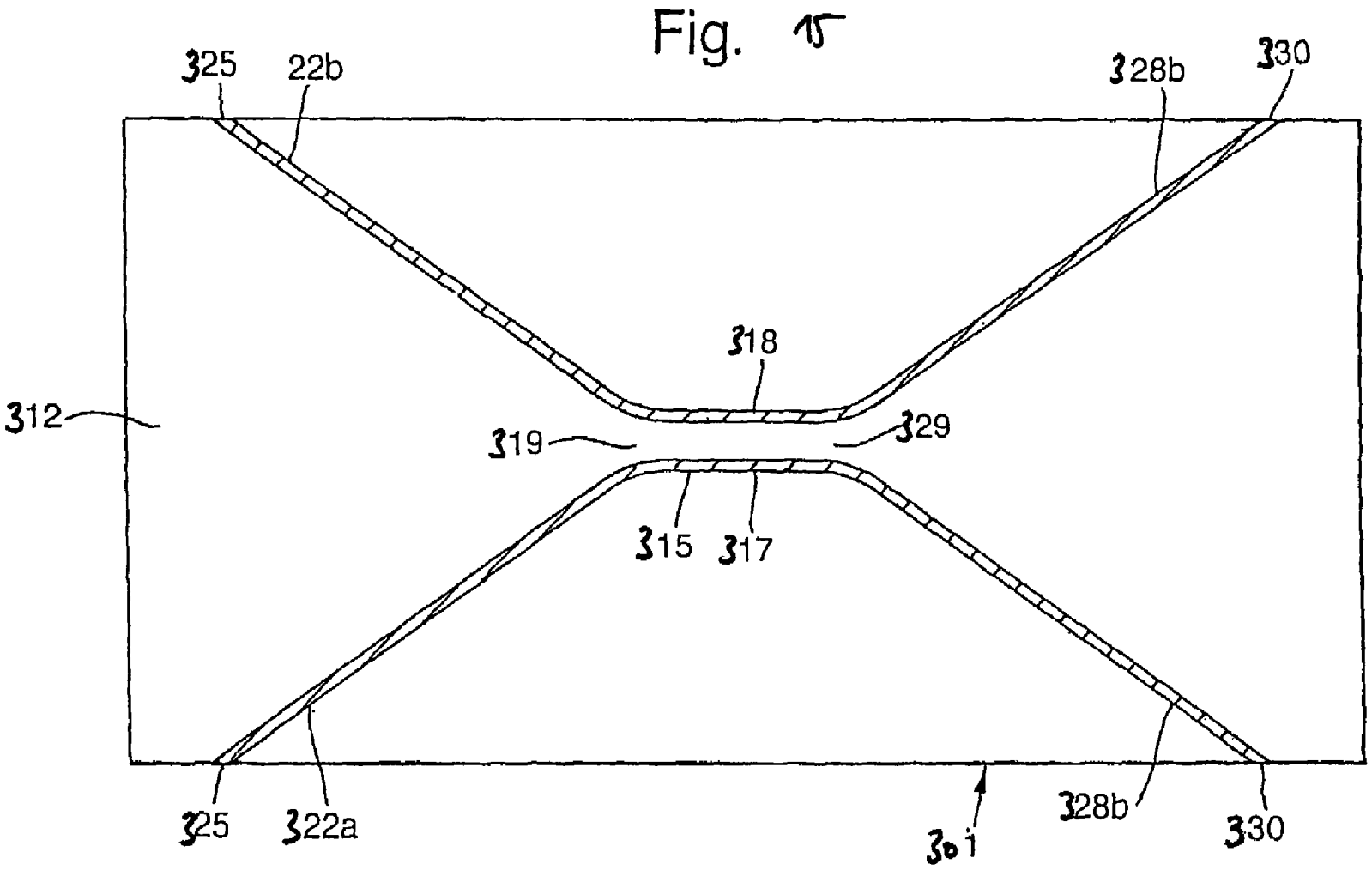
FIG. 15 shows a plan view of the unrolled inner wall of the orienting device of FIG. 14, obtained by cutting the tubular member along line II-II on FIG. 14, and unrolling.

Reference is now made to FIGS. 14-15, and with reference to these Figures an orienting device will be discussed for angularly orienting an elongated tool such as the auxiliary tool when moving through the orienting device. In FIGS. 1-13 such an orienting device has been indicated with reference numerals 40, 240.

A certain angular orientation between the auxiliary tool and the second well string part is preferred for a fail-safe operation of the latching means, both when the auxiliary tool is lowered into the wellbore, and also when it is retracted again. This allows the correct re-positioning of the wellstring interconnection means for reconnection.

In the art of drilling it is known to use so-called mule-shoe devices, which serve to assure that equipment that is lowered in a drill string lands at a predetermined longitudinal position and angular orientation. In a mule-shoe device the landing position is determined by the cooperating action of a key and a circumferential camming rim, which camming rim is arranged so as to guide the key into a slot when the equipment is lowered into the drill string. When the key is in the slot the predetermined longitudinal position and angular orientation have been reached.

The key can be arranged to project inwardly from the inner wall of the drill string, or to project outwardly from the outer surface of the equipment, and the camming rim and slot are arranged on outer surface of the equipment or the inner wall of the drill string, respectively.

The present invention also provides an orienting device for angularly orienting an elongated tool, such as the auxiliary tool discussed hereinbefore, when moving longitudinally inside a tubular wellstring irrespective of the direction of the longitudinal motion.

To this end there is provided an orienting device for angularly orienting an elongated tool when moving longitudinally through a passageway in the orienting device, wherein the elongated tool at its outer wall is provided with an outwardly projecting key, wherein the inner wall of the passageway is provided with two guiding rims forming a central guiding groove through which the key can pass, the guiding groove having upstream and downstream ends, further with an upstream camming rim extending from a position upstream of the guiding groove to the upstream end of the guiding groove fully around the inner wall, and with a downstream camming rim extending from a position downstream of the guiding groove to the downstream end of the guiding groove fully around the inner wall, wherein the camming rims and the guiding rims project sufficiently into the passageway so as to engage, when the elongated tool is moved through the tubular member, the key and to guide the key into the guiding groove, thereby angularly orienting the elongated tool.

The upstream and downstream camming rims of the orientation device according to the invention allow orienting of the elongated tool irrespective of the direction of longitudinal motion. The central guiding groove through which the key can pass determines the angular orientation of the elongated tool, and allows the elongated tool to pass on, with a predetermined orientation, through and beyond the orienting device in either direction.

Preferably, the guiding groove is arranged substantially parallel to the central longitudinal axis, so that the angular orientation of the elongated tool after passing through the orienting device is the same irrespective of the direction of longitudinal motion.

In connection with the present invention the passageway of the orienting device forms part of the passageway of the first wellstring part.

There is also provided a self-orienting elongated tool for assuming a predetermined angular orientation when moving longitudinally through a passageway for the elongated tool, wherein the inner wall of the passageway is provided with a radially inwardly projecting key, wherein the outer wall of the elongated tool is provided with two guiding rims forming a central guiding groove through which the key can pass, the guiding groove having upstream and downstream ends, further with an upstream camming rim extending from a position upstream of the guiding groove to the upstream end of the guiding groove fully around the outer wall, and with a downstream camming rim extending from a position downstream of the guiding groove to the downstream end of the guiding groove fully around the outer wall, wherein the camming rims and the guiding rims project sufficiently outwardly from the outer wall so as to engage, when the elongated tool is moved through the passageway, the key and to guide the guiding groove over the key, thereby angularly orienting the elongated tool.

In the schematic embodiment of FIGS. 14 and 15 the orienting device 301 is shown as a substantially cylindrical tubular member 302 having a passageway 303 with a central longitudinal axis 304. The tubular member suitably forms part of the first wellstring part (6, 108) The orienting device 301 serves for angularly orienting the substantially cylindrical elongated tool 305, when it is moved longitudinally through the passageway 303 of the orienting device 301, as indicated by the arrows 306. The elongated tool 305 at its outer wall 308 is provided with a radially outwardly projecting key 310, corresponding to the key 90 shown discussed above. The sum of the diameter of the elongated tool 305 and the radial thickness of the key 310 is smaller than the inner diameter of the cylindrical tubular member 305.

The key 310 is suitably elongated in longitudinal direction as shown in the Figure, with tapering upstream and downstream ends resulting in a boat-like shape. The key can also be formed by two parts that are spaced apart in longitudinal direction by a suitable distance. The distance can be less then, but also more than the length of the guiding groove 315.

Suitably the key is mounted on the elongated tool in such a way that it has some radial flexibility, e.g. by supporting the key by one or more springs. However, the radial flexibility should be such that even when the key is fully retracted, it extends radially far enough out such that it cannot be forced over a camming rim, so that it must be deflected.

Optionally, one or two anti-collision buttons are arranged upstream and/or downstream of the key 310 and slightly angularly displaced, like the tip shown with reference numeral 316, which is also supported by a spring.

The inner wall 312 of the tubular member is provided with a central guiding groove 315 formed by two rims 317, 18 projecting out of the inner wall 312. The spacing between the rims 317 and 318 is somewhat larger than the width of the key 310, so as to allow the key to pass through the guiding groove 315. The rims 317, 318 of this embodiment are arranged substantially parallel to the central axis 304. There is further arranged an upstream camming rim formed by the rims 322*a*, 322*b*. Each of the rims 322*a*, 322*b* forms an extension of one of the rims 317,318 from the upstream end 319 of the guiding groove 315, and spirals halfway around the inner wall 312 to a point 325 upstream of the guiding groove 315 where the rims 322*a*, 322*b* join. Substantially symmetrically to the upstream camming rim a downstream camming ream is arranged, formed by the rims 328*a*, 328*b*. Each of the rims 328*a*, 328*b* extends from one of the rims 317,318 at the downstream end 329 of the guiding groove 315, and spirals halfway around the inner wall 312 to a point 330 downstream of the guiding groove 315 where the rims 328*a*, 328*b* join.

The free diameter of the passageway 303 as defined by the rims 317,318,322*a*,322*b*,328*a*,328*b* is slightly larger than the diameter of the elongated tool 305 (not taking the thickness of the key 10 into account). The radial thickness of the key and of the rims are selected such that the key can be reliably guided by the rims, for example, in the order of 1-10 mm or more, but with careful design also smaller rims can be used. For an inner diameter of 6 cm (2.5 inch) of the tubular member, a suitable overall length from point 325 to point 330 is 25-40 cm. This allows the orienting device to be arranged as part of a shank of a well drilling bit of 15 cm (6 inch) or 21 cm (8.5 inch) diameter.

During normal operation of the orienting device of this embodiment the elongated tool 305, such as the auxiliary tool 30 discussed hereinbefore, is lowered through the wellstring of which the orienting device forms part, until the elongated tool slides into the tubular member 302 and the key 310 engages the upstream rim 322*a*, 322*b*. Should the key happen to approach exactly the point 325, the slightly angularly displaced anti-collision button 316 engages the camming rim first, and deflects the tool slightly to one side so that the key does not run against point 325. Contrary to the key 310, the anti-collision button is supported such by its spring that it can retract sufficiently so that it can run over a camming rim, for example in the case that the anti-collision button runs against point 325.

At further lowering the rim exerts a torque on the key 310, either left-handed or right-handed depending on which of the rims 322*a* and 322*b* is engaged by the key 310. The elongated tool is thereby angularly deflected until the key slides into the guiding groove 315. With the key 310 in the guiding groove 315 the elongated tool 305 is angularly oriented with respect to the orienting device 301 and the attached drill string.

The elongated tool can be further lowered so that the key leaves the guiding groove 315 at the side of the downstream rim. When no torque is applied on the elongated tool itself the key 310 will not normally engage the rims 328*a*, 328*b* when the elongated tool is moved completely through the passageway 303.

The elongated tool 305 can then for example be operated through a well-drilling bit suitable for through-bit operation which is attached at the downstream side of the orienting device.

When the elongated tool is to be retracted again, it can in general be in an arbitrary angular orientation. During retracting the key 310 will then engage the downstream rim 328*a*,328*b*, and the elongated tool 305 will be angularly deflected until it slides into the guiding groove 315. Since the guiding groove 315 is arranged parallel with the axis 304 of the tubular member 302, the guiding groove 315 ensures an angular orientation which is the same as it was during lowering. With the auxiliary tool 30 as elongated tool 305 the predetermined angular orientation ensures correct operation of the latching/unlatching means.

It shall be clear that this orientation is provided at a known, more downstream, position when the elongated tool is retracted in upstream direction, than when inserting it in downstream direction. The length of the key 310 and of the guiding groove determines the spacing between these positions. Using an elongated key allows a substantial spacing even for a short guiding groove. For use with the present invention the cooperating guiding groove and key are so arranged that, only when the key is properly oriented by the guiding groove, the auxiliary tool can connect to the second wellstring part. When retracting the predetermined angular position allows fail-safe interconnection of the wellstring parts.

The same can also be achieved in a complementary way by exchanging the roles of passageway and elongated tool. To this end the guiding rims/groove, and the upstream and downstream camming rims are arranged on the outer surface of the elongated tool, and the key is arranged on the inner surface of a passageway through which the elongated tool can pass, e.g. a tubular member such as an orienting sub of a drill string. The arrangement of the rims and guiding grooves can be analogous to the embodiment discussed with FIG. 15. In particular, the elongated tool can preferably have substantially cylindrical shape with the rims projecting out of the cylindrical wall, and the plan view of the unrolled outer surface of the elongated tool can be the same as shown in FIG. 15. Such an elongated tool is self-orienting when moving longitudinally through the passageway with key on the inner wall. The elongated tool can be provided with connecting means to other equipment, so that the elongated tool can serve as an orienting means for that other equipment.

The orienting device of the present invention suitably has the form of an orienting sub arranged in the lower part of the upper wellstring part. It can be an integral part of the bit body as shown in FIG. 1, so that no separate orienting sub is needed.

The auxiliary tool can be the elongated tool itself, it can be connectable to the elongated tool, or it can be separate therefrom.

While the illustrative embodiments of the invention have been described with particularity, it will be understood that various other modifications will be readily apparent to, and can be easily made by one skilled in the art without departing from the spirit of the invention. Accordingly, it is not intended that the scope of the following claims be limited to the examples and descriptions set forth herein but rather that the claims be construed as encompassing all features which would be treated as equivalents thereof by those skilled in the art to which this invention pertains.

We claim:

1. A well-drilling bit assembly suitable for through-bit operation comprising a well-drilling bit, which includes a bit body having upper and lower ends having a passageway there through, the bit body being attachable at its upper end to a tubular drill string and the passageway extending between an opening at the upper end and the exterior of the bit body;

a closure element for the passageway co-operating with the lower end of the bit body; and a bit-connecting means for releasably connecting the closure element to the bit body so as to selectively close the passageway;

the well-drilling bit assembly further comprising an auxiliary tool for manipulating the closure element, which auxiliary tool is passable along the passageway in the bit body to the closure element when the bit body and closure element are interconnected with the bit-connecting means, which auxiliary tool comprises a tool-connecting means for selectively connecting the auxiliary tool to the closure element, and an operating means to operate the bit-connecting means which includes releasing the bit-connecting means, and which auxiliary tool comprises a first member which includes the tool-connecting means and a second member which includes the operating means, which second member is movably arranged relative to the first member so that it is movable between a first and a second position relative to the first member, wherein in the first position the tool-connecting means is connectable, at least when the bit body and closure element are interconnected with the bit-connecting means, to the closure element whereby the bit-connecting means is not operable, and whereby in connected condition of the auxiliary tool with the closure element the bit-connecting means is operable by movement of the second member including the operating means between the first and the second position.

2. The well-drilling bit assembly according to claim 1, wherein the tool-connecting means is arranged near the downstream end of the first member, wherein the operating means is arranged near the downstream end of the second member, and wherein the second member is arranged longitudinally slideably along the passageway with respect to the first member, so that the first relative position is an upstream position of the second member, and wherein the second member is moved relative to the first member in downstream direction when moving it towards the second relative position.

3. The well-drilling bit assembly according to claim 2, wherein the first member of the auxiliaiy tool comprises a substantially tubular body in which the second member is coaxially slideably arranged, wherein the closure element comprises at its upstream end an outer sleeve and a coaxial inner sleeve, wherein the upstream end of the outer sleeve is arranged to cooperate with the tool-connecting means so as to lock the auxiliary tool to the outer sleeve, wherein the upstream end of the inner sleeve is arranged to cooperate with the operating means of the auxiliary tool so that the bit-connecting means is operated by longitudinally sliding the inner sleeve with respect to the outer sleeve.

4. The well-drilling bit assembly according to claim 3, wherein the bit body further comprises an operable first retainer device for securing the second member of the auxiliary tool in the first relative position when the auxiliary tool is not connected to the closure element.

5. The well-drilling bit assembly according to claim 4, wherein the bit body is provided with a button which projects into the passageway and co-operates with the first retainer device so as to operate the first retainer device at a predetermined relative position between the button and the first retainer device.

6. The well-drilling bit assembly according to claim 5, further comprising a selectively operable second retainer device for securing the second member of the auxiliary tool in the second relative position when the auxiliary tool is connected to the closure element while the closure element is not connected to the bit body.

7. The well-drilling bit assembly according to claim 6, wherein the bit body is provided with a button which projects into the passageway and co-operates with the second retainer device so as to operate the second retainer device at a predetermined relative position between the button and the second retainer device.

8. The well-drilling bit assembly according to claim 7, wherein the passageway and the auxiliaiy tool are provided with co-operating angular orienting means.

9. The well-drilling bit assembly according to claim 8, wherein the bit body and the auxiliary tool are provided with the co-operating angular orienting means for angularly orienting the auxiliary tool at a first relative position when moving downwardly along the passageway, and at a lower second relative position when moving upwardly again along the passageway.

10. The well-drilling bit assembly according to claim 9, wherein the auxiliary tool at its outer wall is provided with an outwardly projecting key means, wherein the inner wall of the passageway in the bit body is provided with two guiding rims forming a central guiding groove through which the key can pass, the guiding groove having upstream and downstream ends, further with an upstream camming rim extending from a position upstream of the guiding groove to the upstream end of the guiding groove fully around the inner wall, and with a downstream camming rim extending from a position downstream of the guiding groove to the downstream end of the guiding groove fully around the inner wall, wherein the camning rims and the guiding rims project sufficiently into the passageway so as to engage, when the auxiliary tool is moved through the bit body, the key means and to guide the key means into the guiding groove, thereby angularly orienting the auxiliary tool.

11. A wellstring assembly comprising:

an upper tubular wellstring part having upper and lower ends between which ends a passageway is arranged;

a lower wellstring part having upper and lower ends which lower end is connectable to or includes a drill bit, the lower wellstring part co-operating with the lower end of the first wellstring part;

a releasable wellstring-interconnecting means for selectively interconnecting the lower and upper wellstring parts; and an auxiliary tool arranged so that it can pass along the passageway in the upper wellstring part to the lower wellstring part, when the upper and lower wellstring parts are interconnected, wherein the auxiliary tool comprises a tool-connecting means for selectively connecting the auxiliary tool to the lower wellstring part, and an operating means for connecting or releasing the wellstring-interconnecting means, wherein the auxiliary tool comprises a first member which includes the tool-connecting means and a second member which includes the operating means, which second member is arranged movably so that it can assume a first and a second position relative to the first member, wherein in the first position the tool-connecting means is connectable, at least when the upper and lower wellstring parts are interconnected, to the lower wellstring part without operating the wellstring-interconnecting means, and wherein after connecting the auxiliary tool to the lower wellstring part the wellstring-interconnecting means can be operated by moving the second member including the operating means between the first and the second position; and wherein the upper wellstring part and the auxiliary tool are provided with co-operating angular orienting means for angularly orienting the auxiliary tool at a first relative position when moving downwardly along the passageway, and at a lower second relative position when moving upwardly again along the passageway.

* * * * *